US005933575A

United States Patent [19]

Sanders

[11] Patent Number: 5,933,575

[45] Date of Patent: Aug. 3, 1999

[54] WATER HEATING APPLIANCE FOR HOTTUB OR SPA

[76] Inventor: Clifton Omer Sanders, P.O. Box 272, Lower Lake, Calif. 95457

[21] Appl. No.: 09/044,713

[22] Filed: Mar. 19, 1998

[51] Int. Cl.[6] ..... F24H 9/12; H05B 3/40; H05B 3/80

[52] U.S. Cl. ..... 392/501; 392/497; 392/498; 392/499

[58] Field of Search ..... 392/501, 497–99; 126/367; 422/125; 261/DIG. 65

[56] References Cited

U.S. PATENT DOCUMENTS

| | | | |
|---|---|---|---|
| 2,899,533 | 8/1959 | Farmer | 392/497 |
| 3,899,421 | 8/1975 | Keilin et al. | 210/96.1 |
| 4,835,366 | 5/1989 | Owen et al. | 392/499 |

*Primary Examiner*—Teresa Walberg
*Assistant Examiner*—Thor S. Campbell

[57] ABSTRACT

A water heating appliance for use in a hottub or spa with said appliance consisting of an especially designed float-body with a safety shield which protrudes from the bottom of the body and also acts as a heating chamber, with an especially designed float as differs from the float-body that activates and deactivates an on/off switch but is not a part of said switch which allows the flow of electricity to a preset temperature shut-off switch that lets electricity flow to a heating element where it is changed into heat and heats the water in the heating chamber until the temperature sensor of the shut-off switch senses a preset temperature and stops the flow of electricity by opening a circuit in said switch keeping the water from getting too hot and avoids scalding of the user of the hottub or spa. When the appliance is removed from the hottub or spa the float on the bottom of the body deactivates the on/off switch so as to protect the heating element if the user has not removed the power cord from the power outlet and avoid burns incase the element is touched when out of water.

1 Claim, 3 Drawing Sheets

WATER HEATING APPLIANCE FOR HOTTUB OR SPA

BACKGROUND OF THE INVENTION

This invention relates to a water heating appliance for heating cool or room-temperature water in a not often used hottub or spa to a useable temperature in about one hour.

Built-in heating units of hottubs and spas heat the water very slowly giving the owner an option of waiting for many hours for hot water or leaving the unit on all the time and thereby having to pay for wasted electricity. This invention stops that waste.

BRIEF SUMMARY OF THE INVENTION

This invention is directed to a water heating appliance for quickly and safely heating cool water in a hottub or spa that is not often used in approximately one hour thereby saving electricity, and the cost of wasted electricity and giving the owner quicker use of the hottub or spa.

The water heating appliance consists of a sealed float-tank-body which also houses the three electrical components and the connecting electrical wires. The components being an on/off switch, a temperature controled shut-off switch, and the heating-element-head as differs from the heating-element which protrudes from the bottom of the float-tank-body and is incased in a tubular shield/heating-chamber where it is accompanied by the on/off switch activator-deactivator-float and its parts and the temperature sensor-probe as differs from the temperature-sensor-shut-off-switch.

BRIEF DESCRIPTION OF THE SEVERAL VIEWS OF THE INVENTION

DETAILED DESCRIPTION OF THE INVENTION

Figure 1:
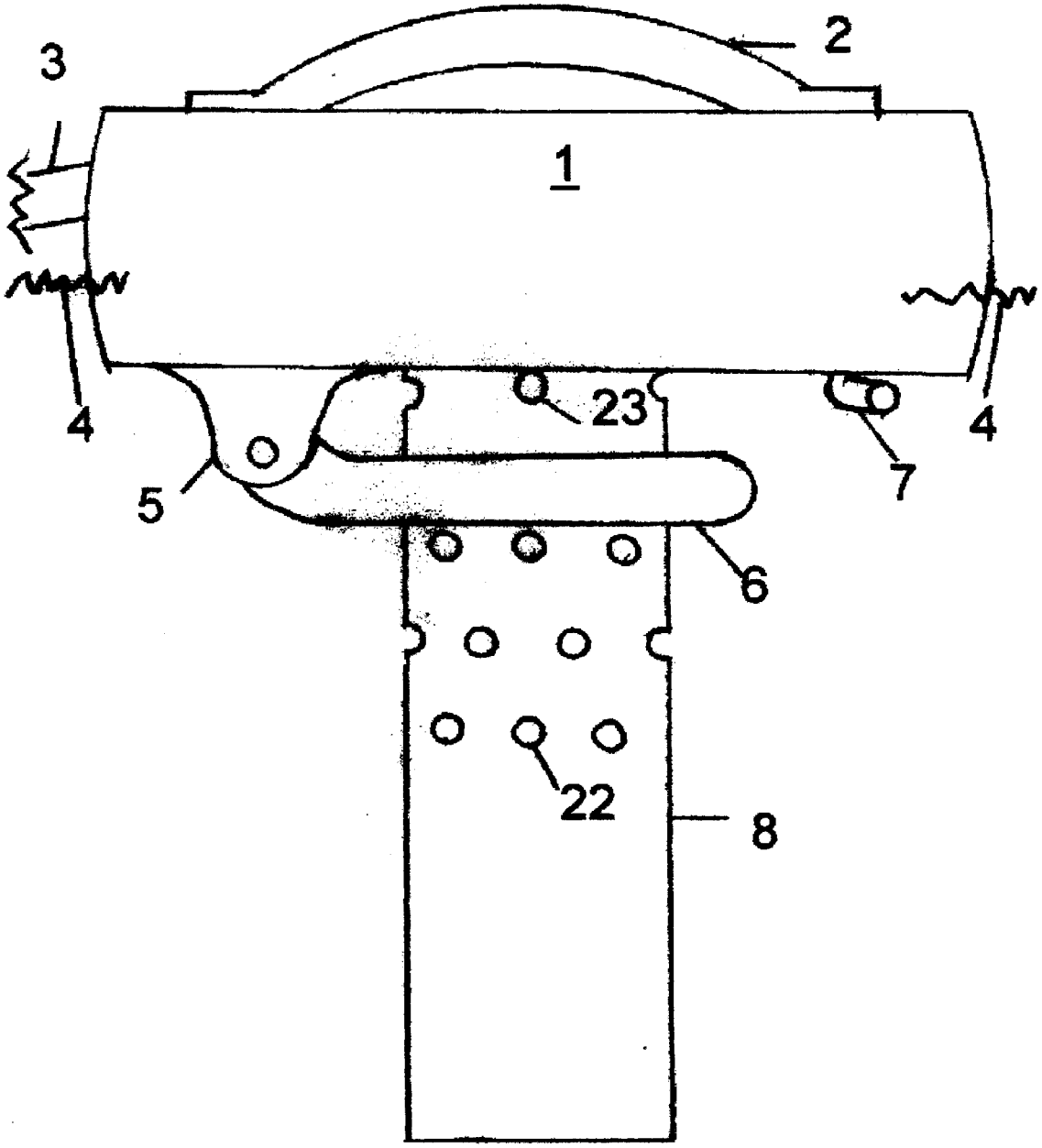
FIG. 1 is an outside view of the water heating appliance of this invention showing the outter apperance and its external parts.
Figure 2:
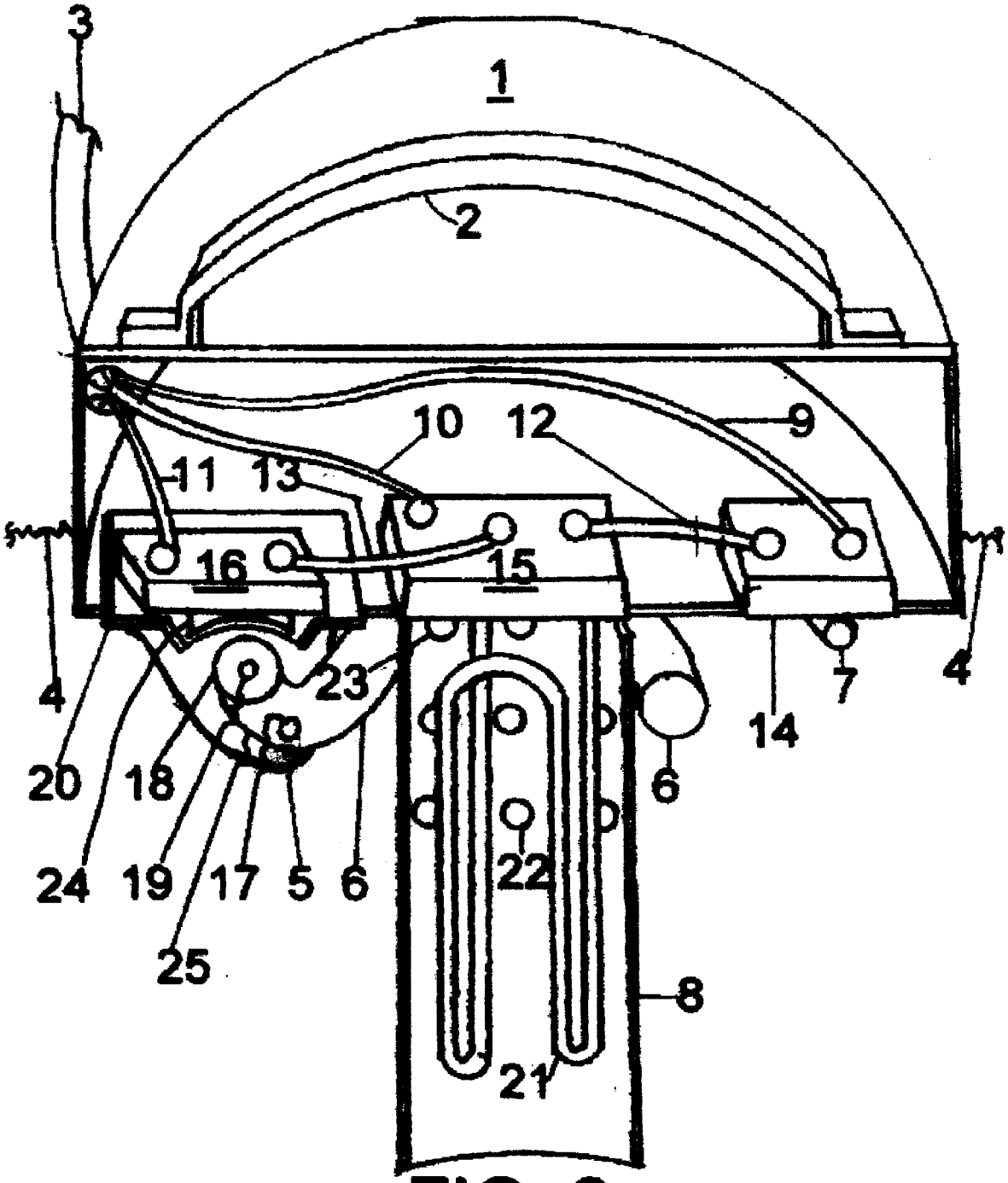
FIG. 2 is a cut-a-way view of FIG. 1 showing all the components and parts of the invention, shown and not shown in FIG. 1.
Figure 5:
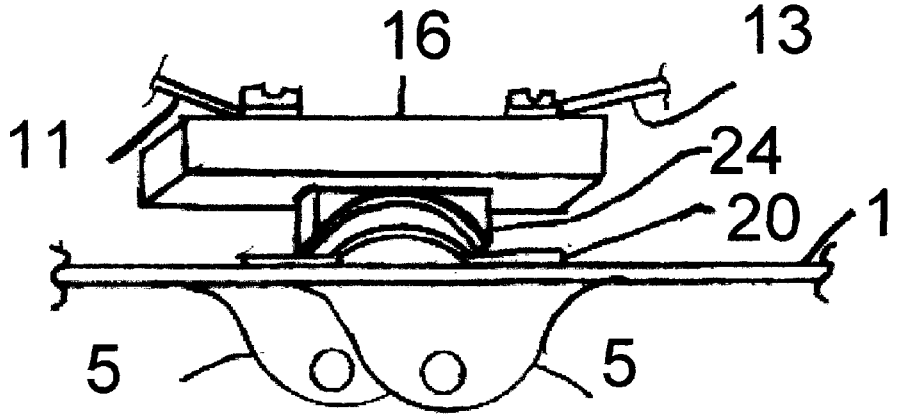
FIG. 5 is an enlarged view of an on/off switch with a rocker type toggle and a flat rubber seal used to keep water from getting into the float-tank-body.
Figure 3:
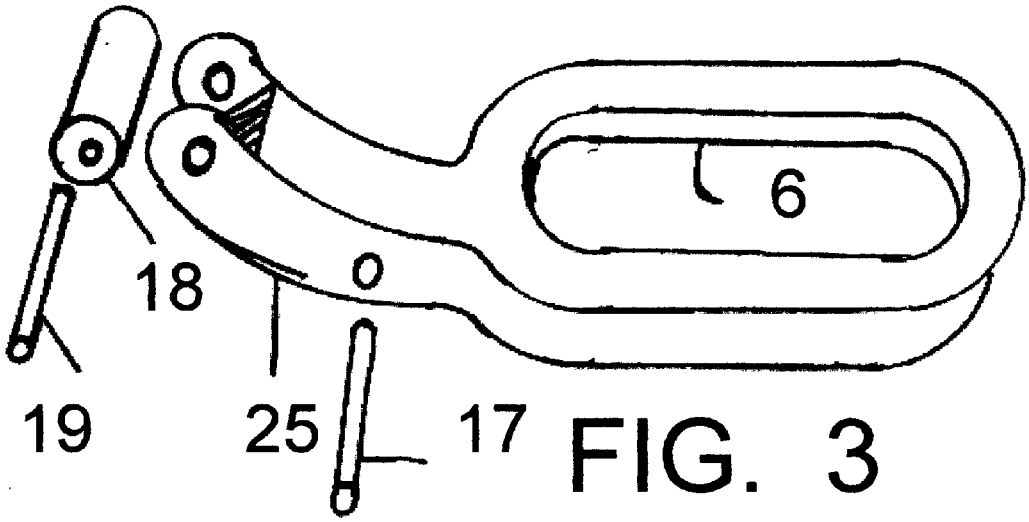
FIG. 3 is an enlarged exploded view of the on/off switch activator-deactivator-float and its parts.
Figure 4:
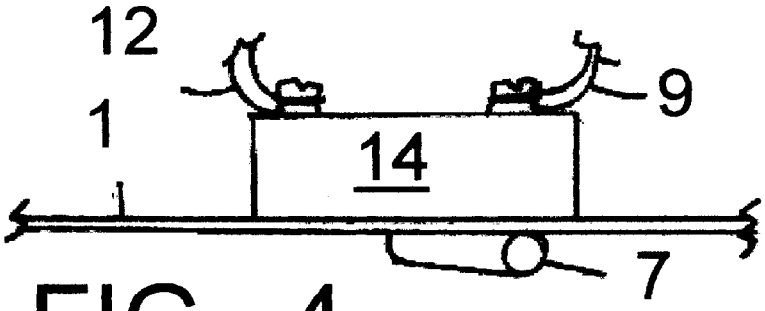
FIG. 4 is an enlarged view of the water temperature sensor-probe and temperature activated shut-off switch.

Referring to FIG. 1 and FIG. 2 a water heating appliance for use in hottubs or spas. The water heating appliance of this invention is used to quickly and safely heat water in a not often used hottub or spa to a useable temperature. The float-tank-body 1 is made of water-proof materials which will not conduct electricity and is sealed including rubber-seal 20 to protect against water contact with electrical components 14, 15, 16 and electrical wires 9, 10, 11, 12 and 13 avoiding danger of shock.

Holding the unit upright by handle 2 so that the on/off-switch-activator-deactivator-float 6 is down and on/off-switch 16 is in off position power-cord 3 maybe connected to a power outlet and the unit is lowered onto and into water 4, which replaces the air in the heating-element-shield/heating-chamber 8 as float 6 which differs from the float-tank-body pivots on pivot-pin 17 held by float-mounts 5 allowing float-finger 25 to push roller 18 which turns on pin 19 and rolls across rubber seal 20 that is between roller 18 and the rocker type toggle 24 of on/off switch 16 thereby turning on/off switch 16 to the on position starting the heating process of electricity passing through wire 12 to shut-off switch 14 which has a closed circuit at this time allowing the electricity to pass through wire 13 to the heating-element-head and is changed to heat in heating-element 21 heating water 4 in heating-element-shield/heating-chamber 8 causing it to rise and push through the holes 22 and the holes 23 to be replaced by cooler water entering through the open bottom. When the water 4 reaches a preset temperature the sensor-probe 7 opens a circuit in the shut-off-switch 14 ending the heating process and power-line 3 consisting of common-wire 9 ground-wire 10 and hot-wire 11 may be removed from the power-outlet and the appliance maybe removed from water 4. As the appliance is removed from water 4 on/off-switch-activator-deactivator-float 6 as differs from float-tank-body 1 pivots on pivot-pin 17 held by float-mounts 5 allowing float-finger 25 to push roller 18 which turns on pin 19 across rubber seal 20 which is in contact with toggle 24 which at that time opens a circuit in on-off-switch 16 stopping the flow of electricity even if the circuit in the shut-off-switch 14 closes thereby protecting the heating-element 21 if the owner forgets to remove power-line 3 from the power-outlet.

While there has been shown and described a preferred embodiment of the water heating appliance of this invention it is understood that changes in structure, materials, sizes and shapes can be made by those skilled in the art without departing from the invention, defined in the following claims.

What I claim as my invention is the construction and assembly of:

1. A water heating appliance used to quickly and safely heat water in a not often used hottub or spa, said water heating appliance comprising:

a housing made of a waterproof material that will not conduct electricity, said housing so constructed as to float on top of a body of water being heated, said housing sealingly enclosing the electrical components and the electrical connections for said electrical components of the appliance in a watertight environment, said electrical components including an on/off toggle switch, a temperature controlled shut-off switch, and an electric heating element head;

a substantially tubular appendage disposed on the bottom of said housing and extending downward therefrom, said substantially tubular appendage encasing the heating end of said electric heating element and acting both as a heating chamber and a protective shield; and an on/off-switch-activator-deactivator float disposed on the bottom of the housing and pivotally mounted thereto by a pin, said on/off-switch-activator-deactivator float mechanically communicating with said on/off switch through a rubber seal so as to prevent fluid intrusion into said housing and so constructed as to activate and deactivate the on/off switch mechanically with a float-finger as said float pivots about said pin by pressing said float-finger against said rubber seal and subsequently said on/off switch toggle, said float-finger activating said on/off switch when said appliance is floating in a body of water and deactivating the on/off switch when said appliance is removed from said body of water, and a power cord for connecting said appliance to a conventional electric power supply.

* * * * *